United States Patent [19]

Burney, Jr. et al.

[11] 4,381,230

[45] Apr. 26, 1983

[54] OPERATION AND REGENERATION OF PERMSELECTIVE ION-EXCHANGE MEMBRANES IN BRINE ELECTROLYSIS CELLS

[75] Inventors: Harry S. Burney, Jr., Clute; Gary R. Gantt, Brazoria, both of Tex.

[73] Assignee: The Dow Chemical Company, Midland, Mich.

[21] Appl. No.: 276,095

[22] Filed: Jun. 22, 1981

[51] Int. Cl.[3] ..... C25B 1/34

[52] U.S. Cl. ..... 204/98; 204/128

[58] Field of Search ..... 204/98, 128, 130

[56] References Cited

U.S. PATENT DOCUMENTS

| | | | |
|---|---|---|---|
| 3,793,163 | 2/1974 | Dotson | 204/98 |
| 3,988,223 | 10/1976 | Hirozawa | 204/98 |
| 4,038,365 | 7/1977 | Patil et al. | 204/128 |
| 4,040,919 | 8/1977 | Eng | 204/128 |
| 4,115,218 | 8/1978 | Krumpelt | 204/98 |
| 4,116,781 | 9/1978 | Dorio et al. | 204/98 |
| 4,155,819 | 5/1979 | Carlin | 204/98 |
| 4,176,022 | 11/1979 | Darlington | 204/98 |
| 4,202,743 | 5/1980 | Oda et al. | 204/98 |
| 4,204,921 | 5/1980 | Britton et al. | 204/98 |
| 4,236,980 | 12/1980 | Medic et al. | 204/98 |

OTHER PUBLICATIONS

"Effects of Brine Purity on Chlor-Alkali Membrane Cell Performance" Charles J. Molnar and Martin M. Dorio, authors, Presented to The Electrochemical Society Fall Meeting, Oct. 1977, Altanta, GA.

"NAFION® Membranes Structured for High Efficiency Chlor-Alkali Cells" Charles J. Hora and Daniel E. Maloney, authors, Presented to The Electrochemical Society Fall Meeting, Oct. 1977, Atlanta, GA.

"The Asahi Chemical Membrane Chlor-Alkali Process" Maomi Seko, author, Presented to the Chlorine Institute, Inc. Feb. 9, 1977, New Orleans, LA (p. 5, Table I headings, p. 7, 1st col. and FIG. 10 and Table 3, p. 8).

"The Commercial Use of Membrane Cells in Chlorine/-Caustic Plants" Dale R. Pulver, author, Presented at The Chlorine Institute's 21st Plant Manager's Seminar, Feb. 15, 1978, Houston, TX, (pp. 6-1, 6-3, 6-8, 6-10, 6-11, 6-12).

"Sodium Chloride", Reinhold Publishing Corporation, New York, Dale W. Kaufmann, Editor, (1960).

*Primary Examiner*—R. L. Andrews

*Attorney, Agent, or Firm*—M. W. Barrow

[57] ABSTRACT

Methods of membrane regeneration of permselective ion-exchange membranes of a brine electrolysis cell are greatly improved when the cells are fed brine which contains little or no carbon dioxide, carbonate anions or bicarbonate anions during normal electrolysis and when the methods of membrane regeneration are those wherein at least one liquid solution contacts the membrane and the pH of that solution is below that of the pH of the electrolyte in contact with the membrane during normal electrolysis.

20 Claims, 1 Drawing Figure

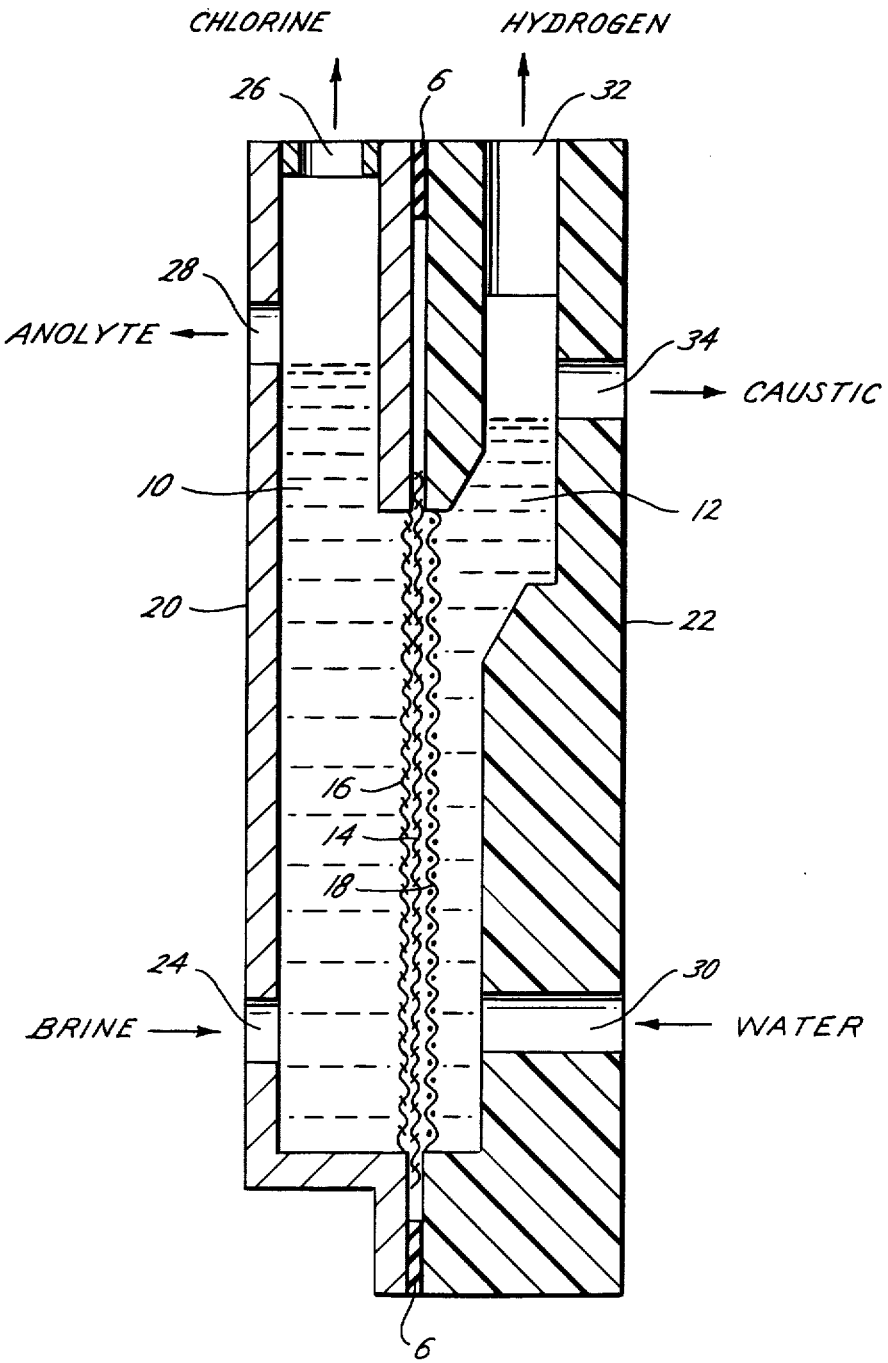
CHLORINE
HYDROGEN
26
6
32
28
ANOLYTE
34
CAUSTIC
10
12
20
22
16
14
18
24
30
BRINE
WATER
6

OPERATION AND REGENERATION OF PERMSELECTIVE ION-EXCHANGE MEMBRANES IN BRINE ELECTROLYSIS CELLS

BACKGROUND OF THE INVENTION

1. Field of Invention

This invention relates to rejuvenating permselective ion-exchange membranes employed as selective barriers between the anolyte and catholyte of brine electrolysis cells.

2. Definitions Used Herein

"Carbon oxide" is used herein to mean carbon dioxide, or carbonic acid, or a carbonate or bicarbonate of an alkali metal or an alkaline earth metal (including magnesium), or a combination of any of these.

"Cathodic protection voltage" is defined herein to mean a cell voltage drop, as measured between the anode to the cathode of a cell, which is just large enough to cause reduction of water to hydrogen and hydroxyl ions at the cathode. Such a cell voltage is, therefore, capable of providing cathodic protection for the cathodes to prevent them from corroding.

3. Discussion of Prior Art

The electrolysis of chlorides of monovalent cations (including lithium, sodium, potassium, rubidium, cesium, thallium and tetra methyl ammonium) with cation selective membranes is well known for the production of chlorine and the hydroxides of such cations, particularly with respect to the conversion of sodium chloride to chlorine and caustic. Representative of such permselective cation exchange membranes are the perfluorosulfonic acid membranes made and sold by the E. I. duPont de Nemours & Co., Inc., under the tradename, Nafion, and the perfluorocarboxylic acid membranes of the Asahi Glass Industry Co., Ltd. of Tokyo, Japan. See U.S. Pat. No. 4,065,366 to Oda et al for a description of the latter carboxylic acid type membranes.

In the process of electrolyzing sodium chloride into chlorine and caustic wherein such membranes are used, the membrane divides the cell into anode and cathode compartments. Brine is fed to the anode compartment and water is fed to the cathode compartment. A voltage impressed across the cell electrodes causes the migration of sodium ions through the membrane into the cathode compartment where they combine with hydroxide ions (created by the splitting of water at the cathode) to form an aqueous sodium hydroxide solution (caustic). Hydrogen gas is formed at the cathode and chlorine gas at the anode unless a depolarized cathode is used. (When a depolarized cathode is used, $H_2$ gas is not generated.) The caustic, hydrogen and chlorine may subsequently be converted to other products such as sodium hypochlorite or hydrochloric acid.

It is known that over a long period (>100 days) of use of such membrane-type cells, there occurs an undesirable increase in the cell voltage and electrical energy consumed per unit (e.g. ton) of product made. The prior art in general has attributed this undesirable increase to the fouling of the membrane by hardness and other multivalent cation impurities contained in the brine feed.[1] The calcium cation in particular has been singled out as the most damaging impurity.

[1]See U.S. Pat. No. 3,793,163 to R. S. Dotson (1974); *The Asahi Chemical Membrane Chlor-Alkali Process*, page 5 of a paper presented by Maorni Seko of Asahi Chemical Industry Co., Ltd., of Tokyo, Japan, at The Chlorine Institute, Inc., 20th Chlorine Managers Seminar, at New Orleans, Louisiana on Feb. 3, 1977; *Effect of Brine Purity on Chlor-Alkali Membrane Cell Performance*, a paper originally presented by Charles J. Molnar of E. I. duPont de Nemours & Co., Inc., and Martin M. Dorio of Diamond Shamrock Corporation at The Electrochemical Society Fall Meeting held October, 1977, at Atlanta, Georgia; *The Commercial Use of Membrane Cells in Chlorine/Caustic Plants*, pages 6–9 of a paper presented by Dale R. Pulver of Diamond Shamrock Corporation at The Chlorine Institute's 21st Plant Manager's Seminar, at Houston, Texas, on Feb. 15, 1978; Nafion® *Membranes Structured for High Efficiency Chlor-Alkali Cells*, a paper presented by Charles J. Hora of Diamond Shamrock Corporation and Daniel E. Maloney of E. I. duPont de Nemours & Co., Inc., at The Electrochemical Society Fall Meeting, October, 1977, Atlanta, Georgia; U.S. Pat. No. 4,115,218 to Michael Krumpeit (1978); U.S. Pat. No. 4,073,706 to Zoltan Nagy (1978); U.S. Pat. No. 3,988,223 to S. T. Hirozawa (1976); U.S. Pat. No. 4,204,921 to W. E. Britton et al (1980); U.S. Pat. No. 4,202,743 to Oda et al (1980); and U.S. Pat. No. 4,108,742 to Seko et al (1978).

To prolong the useful life of these membranes many techniques have been developed to reduce the amount of contaminants in the brine which foul the membrane. Many of the references cited above give methods for further reducing the multivalent cation impurities contained in the cell's feed brine. A very recent technique discovered for reducing membrane fouling centers around using brine which contains very little carbonate anions or carbon dioxide (carbon oxides) in the feed brine. This technique is disclosed in a recently filed patent application entitled, "Membrane Cell Brine Feed", having Ser. No. 248,670 and a filing date of Mar. 30, 1981, and having as inventors Bobby Ray Ezzell and Harry Stevens Burney, Jr. The latter named inventor is a co-inventor of the instant invention, and this prior patent application is incorporated by reference herein as is set forth at length for purposes of prior art teachings and for the new techniques taught therein pertaining to obtaining improved brine for electrolysis in an electrolytic cell which employs a permselective membrane disposed between the anode and cathode.

To further prolong the life of these permselective membranes, several techniques for regenerating them in place have been developed. For example, U.S. Pat. No. 4,115,218, by Michael Krumpelt (issued Sept. 19, 1978) teaches that such membranes can be rejuvenated by merely reducing or interrupting the cell current or voltage alone or in combination with a concomitant flushing of the catholyte portion of the cell. This process is limited to the instance where the brine fed to the cell during its normal operation contains a calcium content which is less "than is ordinarily used".

Another example of membrane regeneration is found in U.S. Pat. No. 3,988,223, by Stanley T. Hirozawa (issued Oct. 26, 1977). This patent teaches unplugging the membrane by a process which comprises maximizing the brine head, adding a chelate or chelate forming agent to the anolyte, shunting the electrical current to the cell, flushing the cell, and removing the shunt.

A third example of membrane regenerating is found in U.S. Pat. No. 4,040,919, by Jeffrey D. Eng (issued Aug. 9, 1977). This patent teaches these membranes can be regenerated by increasing the acidity of the anolyte, diluting the electrolyte located immediately adjacent to the anolyte and separated from the anolyte by a membrane, reducing the current density, and maintaining such conditions during electrolysis for a period sufficiently long to rejuvenate the membrane. Note, usually the electrolyte referred to in this patent can be the catholyte, but it does not have to be. It can be an electrolyte located between two spaced membranes which are both located between an anode and a cathode.

These membrane regenerating techniques are an improvement over the alternative of replacing the membranes, but only marginally so in many instances. Generally these techniques produce only a short term improvement, particularly short term improvements insofar as are concerned the cell voltage and cell energy requirement (unit of energy used to make a unit of cell product).

It is not certain why these membrane regenerating techniques usually produce only short term improvements, but it seems in accordance with the discovery of the present invention that these techniques can readily remove some salts from the membrane, but can remove substantial amounts of impregnated calcium carbonate only at the expense of doing considerable damage to the membrane. It would be advantageous to overcome these deficiencies, and the method of the present invention at least partially does.

SUMMARY OF THE INVENTION

This invention relates to a method of operating and regenerating an electrolysis cell which electrolyzes an aqueous alkali metal halide solution (a brine) to a halogen at the anode of the cell and to an alkali metal hydroxide at the cathode of the cell. The particular cells for which this method is particularly useful are those which contain a permselective ion-exchange membrane so disposed between the anode and cathode as to form a selective barrier between the anolyte and catholyte, thereby separating the space around the anode into an anolyte compartment and the space around the cathode into a catholyte compartment. This method comprises the combination of steps of:

A. feeding to and electrolyzing in such a cell a brine which contains no more than about 5 ppm hardness (expressed as ppm calcium) and no more than about 70 ppm "carbon oxide" (expressed as ppm $CO_2$) during at least 50% of the cell's normal electrolysis operation, with said maximum concentrations of "carbon oxide" and hardness occurring prior to, or at least immediately prior to, the brine's becoming part of the cell's anolyte; and B. regenerating the membrane after it has eventually become at least partially fouled with compounds of multivalent cations from the brine fed to the cell during the cell's normal electrolysis step (Step A above) by contacting the membrane on at least one of its sides with a solution capable of dissolving the multivalent cation compounds fouling the membrane for a time sufficient to dissolve a substantial amount of said compounds fouling said membrane. Preferably both sides of said membranes are contacted. In any event the pH of the solution is maintained below the pH of the electrolyte which was in contact with that side of the membrane during the normal electrolysis step (Step A above) for a time sufficient to dissolve most of the compounds of polyvalent cations plugging and/or fouling the membrane.

Halides are taken to mean their ordinary meaning herein, i.e. primary compounds of the halogens. Examples are sodium chloride, potassium chloride, sodium bromide and the like.

Membranes have been found to be much better regenerated with less damage done to the membrane using the above method of cell operation and rejuvenation.

Preferably the membrane is regenerated in place in the cell. In this case reducing the pH in Step (B) above can be achieved by a number of methods. The current density and/or cell voltage can be significantly reduced or completely cut off. Increasing the flow rate of water to the catholyte compartment over that rate used during normal cell electrolysis (Step A) will reduce the catholyte pH. Adding more acid to the anolyte compartment or brine being fed to the anolyte compartment will reduce the pH in the anolyte compartment. Other methods of achieving the lowering of pH required by Step (B) above will readily occur to those skilled in the art if it is kept in mind that the object of reducing the pH is to reduce the pH inside the membrane to dissolve the foreign salts impregnated therein by maintaining a liquid solution in contact with the membrane on one or both sides to receive these salts when dissolved.

A further feature of this invention is the protection of the cathodes from corrosion during the membrane regenerating step (Step B above). This can be achieved by the addition of corrosion inhibitors to the catholyte compartment and/or reducing the cell voltage to the "cell cathodic protection voltage" defined above.

A yet further feature of this invention is that if the membrane is dried after the contaminating salts have been dissolved from it in Step (B) above, the membrane regeneration is further enhanced.

BRIEF DESCRIPTION OF THE DRAWING

The drawing is a sectional side view of a lab mini-cell which is representative of those used in the Examples given below in the Detailed Description.

DETAILED DESCRIPTION OF THE INVENTION

This invention is the discovery that better membrane regenerations can be obtained by operating the cell with certain newly discovered brine conditions. These newly discovered brine feed conditions are that the brine fed to the cell's anolyte compartment have no more than about 70 ppm "carbon oxide" (as defined above and expressed as ppm $CO_2$) prior to the brine feed becoming part of the anolyte. In the anolyte virtually all of the "carbon oxide" is or becomes carbon dioxide, and is swept from the cell without harming the membrane. It is a theory of the inventor of this co-pending application that a residual of the carbon dioxide close to the membrane in the cell's anolyte chamber is in the form of carbonate anions. It is a further theory that a very small, but significant, part of these residual carbonate anions react with calcium and are deposited on and in the membrane. That invention, of course, is not limited to those theories, but it is the only explanation of which the inventors can think which explains the significant improvements they discovered when feeding such low "carbon oxide" containing brine to membrane-type brine electrolysis cells. The improvements discovered for use of such low "carbon oxide" containing brine are that there is a substantially less increase in cell voltage and electrical energy consumed per unit of product made over a long term use of a membrane-type brine electrolysis cell, without having to resort to such drastic and expensive brine preparation techniques such as the one taught wherein the calcium concentration must be reduced to less than the extremely low concentration of 0.08 ppm., U.S. Pat. No. 4,202,743 to Yoshio Oda et al (issued May 13, 1980).

As is taught in the above cited co-pending aplication incorporated by reference herein, there are more desirable parameters for the brine feed than the upper limit of 70 ppm "carbon oxide" (expressed as ppm $CO_2$). For example the less "carbon oxide" present, the better the cell performs. Thus brine feed containing less than about 50 ppm "carbon oxide" is better than that containing 70 ppm; brine containing less than about 30 ppm is better than that containing 50 ppm; brine containing less than 10 ppm is better than that containing 30 ppm; and brine containing less than 2 ppm is very much to be preferred. Also brine which has a low hardness content (expressed as ppm calcium) in addition to having a low "carbon oxide" content was discovered to produce even better results. Brine containing less than about 5 ppm hardness is acceptable; brine containing less than about 3 ppm hardness is preferred; and brine containing less than about 1–2 ppm hardness is even more preferred. The pH of the brine after it becomes anolyte was also found to have a significant effect on cell performance. A pH of less than about 4 is acceptable; a pH of less than 3.0 is preferred; and a pH of about 2.0 is most preferred.

The low "carbon oxide" content of this brine can be achieved by several methods. One is not to place it there in the first instance, but the most practical method is to remove it after using a conventional brine treatment wherein: (a) sodium carbonate (in molar excess with respect to the calcium present in the brine) is added to the brine to form insoluble forms of calcium carbonate and sodium hydroxide (in molar excess with respect to the magnesium present in the brine) is added to the brine to form insoluble forms of magnesium; and (b) these insoluble forms of calcium and magnesium are substantially all then separated from the brine leaving a brine containing the excess amounts of carbonate and hydoxide anions. This conventionally treated brine can then be treated with a sufficient amount of mineral acid, preferably hydrochloric acid, to convert the carbonate anions to carbon dioxide. This carbon dioxide can be removed by allowing it to set for a few days much like an opened bottle of a carbonated soft drink; or it can be removed more rapidly by agitation such as shaking or stirring; or more rapidly by a gas purge with an innocuous gas such as chlorine gas, air, nitrogen, or the like; or even more rapidly by a combination of agitation and gas purge.

The hardness can also be reduced by methods such as contacting the brine with chelating ion exchange beds, or solvent extraction techniques.

The anolyte pH can be lowered and controlled by methods such as adding hydrochloric aid and/or flow controlling the brine to the cell.

Better appreciation of the present invention can be obtained by those skilled in the art from a study of the following six examples. The first two examples are examples of prior art while the latter four are examples of the present invention. The two prior art examples both show the inferior regenerative effect obtained by regenerating membranes after they had been fed brine containing relatively normal concentrations of "carbon oxide" during the normal cell electrolysis step preceding the membrane regeneration step. In the first of these prior art examples, the "carbon oxide" was predominately in the form of carbonate anions ($CO_3^{--}$), whereas in the second prior art example, the "carbon oxide" was predominately in the form of entrained carbon dioxide gas. The pH of the brine feed determines what forms the "carbon oxide" will take.

Before presenting these examples, however, it is useful to present a set of definitions of cell performance and a description of the type of cell used in all six examples.

DEFINITION OF CELL PERFORMANCE

One parameter which is important in considering a cell's energy performance is the strength of the caustic produced, for the more concentrated the caustic produced, the less energy is later required in evaporating water from the caustic after it has left the cell and is being concentrated. The purity of the caustic soda product is also important to over-all process economics. Preferably sodium chloride and sodium chlorate in the caustic are maintained as low as possible. The actual level of these impurities is a function of cell operating parameters and the characteristics of the membrane. Over the life of a membrane cell these impurities are preferably maintained at the same level as when the cell was new.

The two other parameters required for a complete energy view of the overall process, particularly over a long period of time, are current efficiency and cell voltage. Cell voltage is defined to be the electrical potential as measured at the cell's anode connection to the power supply and the cathode connection to the power supply. Cell voltage includes the chemical decomposition voltages and the IR associated with current flowing through electrodes, membrane and electrolytes.

Current efficiency is a measure of the ability of the membrane to prevent migration into the anode compartment of the caustic produced at the cathode. Herein it is also referred to as caustic efficiency and NaOH efficiency. Caustic efficiency is defined as the actual amount of caustic produced divided by the theoretical amount of caustic that could have been produced at a given current. The most common method of comparing the performance of an electrolytic process combines both current efficiency and voltage into a single energy term. This energy term is referred to as the cell's "energy requirement", and is defined to be the amount of electrical energy consumed per unit of NaOH produced. It is usually expressed in killowatt hours (KWH) of electricity consumed per metric ton (mt) of NaOH produced. The method of determining this energy term is the multiplication of voltage by the constant 670 killoampere-hours, and divided by the current efficiency. Lower current efficiency decreases the quantity of NaOH produced (mt), and higher voltage increases the quantity of KWH used; thus the smaller the "energy requirement" value KWH/mt, the better the performance of the cell.

CELL TYPE USED IN EXAMPLES

The examples set forth below were run in laboratory size cells like that depicted in the drawing. These cells had an anolyte compartment 10 and a catholyte compartment 12. These two compartments were separated by a vertically disposed, permselective cation exchange membrane 14. The membrane was sealed between anode frame 20 and cathode frame 22 by gaskets (not shown) located on either side of membrane 14. Gasket 6 represents the gasket sealing means used between anolyte compartment 10 and catholyte compartment 12. Near membrane 14 was disposed a vertical, parallel, flat-shaped anode 16. On the opposite side of membrane 14 was disposed a vertical, parallel, flat-shaped cathode 18. Anode 16 was an expanded-metal sheet of titanium having a $TiO_2$ and $RuO_2$ coating. Cathode 18 was made of woven-wire mild steel. Of course, other type cathodes can be used such as low overvoltage cathodes. During regeneration, it is very important to protect these low overvoltage cathodes from corrosion such as by the method employed in Invention Example 4 on its 257th day as described below.

The mechanical supports and D.C. electrical connections for anode 16 and cathode 18 are not shown as they would serve more to obscure the drawing. Suffice it to say that anode 16 and cathode 18 were mechanically supported by studs which passed through the cell walls and to which were attached D.C. electrical connections necessary to conduct current for electrolysis. The electrical power passed through the cell was capable of being regulated so that a constant current density per unit of electrode geometrical area—i.e., amperes per square inch (ASI)—could be maintained during normal cell operation.

Also not shown are the flow devices used to control the cell flow rates. The cells were equipped with a glass immersion heater (not shown) in the anolyte compartment in order to maintain the cell at an elevated temperature.

Basically the cell frame was made of two types of materials. The anolyte side 20 was made of titanium so as to be resistant to the corrosive conditions inside the anolyte compartment 10. The catholyte side 22 was made of acrylic plastic so as to be resistant to the corrosive caustic conditions inside the catholyte compartment 12. The necessary entry and exit ports for introducing brine and water and for removing $H_2$, $Cl_2$, spent brine, and caustic soda are shown in the drawing.

Anolyte side 20 has port 24 for the brine feed to the cell anolyte chamber 10. Port 26 provided an outlet for the chlorine generated in the anolyte compartment 10, while port 28 provided an exit for spent brine to leave the anolyte compartment 10 during normal cell operation.

Catholyte side 22 of the cell had port 30 as an inlet for water to the catholyte compartment 12. Outlet port 32 provided an exit for the hydrogen gas generated in the catholyte compartment 12, while port 34 provided an exit for liquid caustic also generated in catholyte compartment 12 during normal cell operation.

During normal cell operation the cell in each of the following examples electrolyzed brine at a constant current density, a constant temperature, and a constant caustic concentration during the long electrolysis step(s) before (and between) the membrane regeneration step(s). These conditions however, were not the same in each example, nor was the membrane used the same in each example. When concentration percentages are given, they are intended to be weight percentages.

PRIOR ART EXAMPLE #1

A lab cell like that described above was operated at 1.0 ASI, 80° C., 12–13 wt. % NaOH in the catholyte, 18–19 wt. % NaCl in the anolyte, and at an anolyte pH of about 4.0–4.3. This cell was operated with brine that contained from 0.4 to 0.9 gram/liter (gpl) $Na_2CO_3$. Use of brine with this high a carbonate ion concentration is representative of prior art operations, but it is not representative of the method of the present invention.

The permselective membrane employed was Nafion® 324 obtained from E. I. duPont de Nemours & Co., Inc. This membrane was a composite of two layers of sulfonic acid polymer and a reinforcing scrim. Similar membranes are described in U.S. Pat. No. 3,909,378.

The sodium chloride brine was obtained from brine wells located near Clute, Tex. This brine was treated so that it was 25.5 wt. % NaCl and contained 1–2 ppm hardness (calcium and magnesium content expressed as ppm Ca).

This brine was treated by what is referred to as conventional brine treatment, i.e. that type of brine treatment which has conventionally been used in preparing brine for electrolysis in asbestos diaphragm-type electrolysis cells for the past many years. Conventional brine treatment comprises adding $Na_2CO_3$ and NaOH to the brine in amounts such that the $Na_2CO_3$ is in a stoichiometric excess of at least about 0.4 gpl (grams per liter) with respect to the calcium present in the brine and such that the NaOH is in a stoichiometric excess of at least about 0.2 gpl with respect to the Mg in the brine. Addition of these excesses of $Na_2CO_3$ and NaOH cause substantially all of the Ca and Mg to form the insolubles, $CaCO_3$ and $Mg(OH)_2$. These insolubles are then removed from the brine feed, usually by settling and filtration techniques, leaving in the brine the excesses of $Na_2CO_3$ and NaOH as well as a small residual of Ca and Mg as hardness. (This small residual of hardness is on the order of from about 1 ppm to about 5 ppm, expressed as ppm Ca).

In this example, the brine was treated by this conventional brine process to reduce the brine hardness to a level of 1–2 ppm expressed as Ca. The procedure followed to obtain this hardness level was as follows: $Na_2CO_3$ and NaOH were added to the untreated brine at the well-sight. The brine was then settled and filtered to reduce the hardness to about 1–2 ppm Ca. The $Na_2CO_3$ was added in stoichiometric excess with respect to the Ca present, so that the filtered brine contained about 0.4 to 0.9 gpl (grams per liter) $Na_2CO_3$. The NaOH was added in stoichiometric excess to the Mg present, so that the filtered brine pH was about pH 10–12. Normal electrolysis was started and continued for about 282 days using this brine.

On the 283rd day after initial start-up, the membrane was regenerated in situ according to the following procedure. Cell voltage was reduced by turning the cell operating current completely off. Aqueous HCl was added to and mixed with the feed brine to obtain an acidified brine with a pH of 0.1 to 1.0. This acidified-brine was fed to the anolyte compartment of the cell at a flow rate that was the same as that during normal electrolysis (approximately 9 milliliters per minute). The same water flow rate as used during normal cell operation was fed to the catholyte compartment (approximately 3¾ milliliters per minute). The membrane in this cell was regenerated in this manner for 20 hrs. at a room temperature of 25° C. The cell was then restored to normal operation at 1.0 ASI, 80° C., 12–13% NaOH, 18–19% NaCl in the anolyte, and an anolyte pH of 4.0–4.3.

The data in Table I summarize the cell performance before and after the membrane regeneration procedure.

In this and the following tables, "DOL" indicates the number of days on line, which is approximately equivalent to the number of days that the cell was operated. A few times the cells were shut down because of loss of electrical power, and a hurricane evacuation caused a two day shut-down. Thus DOL is not exact. "Cell Volts", "NaOH Efficiency" and "Energy Requirement" are the same as defined earlier. "Salt in Caustic" is the weight percent NaCl in the caustic soda product expressed on a 100% NaOH basis. For example, all the data in this table are at about 12 wt. % NaOH, and 100% NaOH divided by 12% NaOH, multiplied by the actual wt. % NaCl in this 12% NaOH equals the wt. % NaCl on a 100% NaOH weight basis.

TABLE I

| DOL | Cell Volts | NaOH Efficiency | Salt in Caustic | Energy Requirement |
|---|---|---|---|---|
| 20 | 3.13 | 88 | 0.081 | 2380 |
| 280 | 3.70 | 90 | 0.046 | 2750 |
| 283 | Membrane Regenerated | | | |
| 288 | 3.42 | 88 | 0.094 | 2600 |
| 350 | 3.70 | 89 | 0.053 | 2790 |

Of particular interest in the data of this table is the amount of decrease in NaOH efficiency observed as occurring from just before to just after the membrane regeneration. In this prior art example, the efficiency declined by two percentage points. As will be shown in examples of the present invention this undesirable side effect of membrane regeneration can be eliminated. (See Invention Example 1 below).

PRIOR ART EXAMPLE #2

A lab cell like that described in Prior Art Example #1 was operated and the membrane regenerated. Cell operation and membrane regeneration differed from Prior Art Example #1 in the following ways. The membrane was of the same type, but the lot number and date of manufacture were different. This difference alone can account for some small differences in cell performance and should be considered when comparing data from various tables.

Cell operation was at an anolyte pH of about two instead of 4.0–4.3. This difference was obtained by adding aqueous HCl to and mixing it with some of the same type conventionally treated brine as prepared and described in Prior Art Example #1, and then feeding a combination of some of this acidified-brine and some of the conventionally treated brine to the anolyte chamber. The acidified-brine solution contained a NaCl concentration of about 25 wt. %, an HCl concentration of about 3 wt. % HCl, a $CO_2$ content of only about one ppm, and a total hardness of 1–2 ppm as Ca. The acidified-brine made up only about 25% of the total brine fed to the cell. Because the resulting combined mixture of acid-brine and conventionally treated brine contained in excess of 100 ppm $CO_2$, this type cell operation is not representative of the present invention.

Normal electrolysis was started and continued for about 227 days using the above described mixture of acid-brine and conventionally treated brine. On the 228th day after initial start-up, the membrane was regenerated in situ according to the following procedure. Cell voltage was reduced by reducing the operating current from 1.0 ASI to 0.03 ASI. Acid-brine similar to the 3% HCl acid-brine described above, but containing 0.13 wt. % HCl, was fed to the anolyte compartment at a flow rate slightly higher than the normal brine flow rate used during the days of normal electrolysis. The water feed to the catholyte was increased above the flow rate used during normal electrolysis so as to maintain a caustic concentration of about 0.4 wt. % NaOH during the membrane regeneration step. Cell temperature was maintained at about 60° C. and air was bubbled into the anolyte compartment to provide mixing. Membrane regeneration was continued in this manner for 20 hours. Then the cell was returned to normal electrolysis conditions of 1.0 ASI, 80° C., 12–13% NaOH, 18–19% NaCl in the anolyte, and an anolyte pH of about two.

The data in Table II summarize the cell performance before and after the membrane regeneration procedure.

TABLE II

| DOL | Cell Volts | NaOH Efficiency | Salt in Caustic | Chlorate in Caustic | Energy Requirement |
|---|---|---|---|---|---|
| 26 | 3.04 | 88 | 0.134 | 2 ppm | 2310 |
| 225 | 3.23 | 87 | 0.078 | 23 | 2490 |
| 228 | Membrane Regenerated | | | | |
| 231 | 3.11 | 86 | 0.280 | 43 | 2420 |
| 251 | 3.25 | 86 | 0.160 | 12 | 2530 |

In the table "DOL", "Cell Volts", "NaOH Efficiency", and "Energy Requirement" are the same as defined earlier. "Chlorate in Caustic" is the ppm $NaClO_3$ impurity in the caustic on a 100% NaOH weight basis.

In this Prior Art Example there was a substantial increase in both salt and chlorate impurity in the caustic after the membrane regeneration step. A salt concentration of 0.28 wt. % and a $NaClO_3$ concentration of 43 ppm represent unacceptably high levels of these impurities. Above 0.20 wt. % NaCl and above 25 ppm $NaClO_3$ are considered unacceptable. Also as noted in the table, cell voltage returned to an unacceptably high level after only 23 days. As will be shown later in the following examples, the method of the present invention results in a significant improvement in long term cell performance, and it also provides the following: less frequent membrane regeneration steps are required to maintain a given level of cell performance and caustic product purity is maintained at acceptable levels after the membrane regeneration step (see Invention Examples 1, 2, 3, and 4 below).

INVENTION EXAMPLE 1

A lab cell like that described in Prior Art Example #1 was operated and the membrane regenerated as required to maintain acceptable cell performance. The major difference in operation between the cell in Prior Art Example #1 and the cell in this example was the level of $CO_2$ ("carbon oxide") in the brine which was fed to the anolyte compartment.

In order to reduce the $CO_2$ content of the brine solution which was fed to the anolyte compartment of the cell during normal electrolysis, the following procedure was used. The same conventionally treated brine as used in Prior Art Example #1 was acidified using aqueous HCl. The brine was mixed and sparged with nitrogen to aid in the removal of entrained $CO_2$ for a period of about 16 hours. The resulting acidified brine contained about 25.5 wt. % NaCl, 0.65 wt. % HCl, about 1 ppm Ca total hardness, and less than 1 ppm $CO_2$. This acid-brine was then fed to a cell containing a Nafion® 324 membrane which was operated at 1.0 ASI, 80° C., 12–13 wt. % NaOH, and 18–19 wt. % NaCl in the anolyte, and at an anolyte pH of about 1.5–3.0 during normal electrolysis. Normal electrolysis was started and continued for 209 days.

On the 210th day after initial start-up, the membrane was regenerated in situ using a procedure similar to the one in Prior Art Example #1. Cell voltage was reduced by turning the cell operating current completely off. The same acid-brine used during normal electrolysis was fed to the anolyte compartment at the same flow rate as used during normal electrolysis. Water at the same flow rate as used during normal cell operation, was continuously fed to the catholyte compartment. The membrane in this cell was regenerated in this manner for 24 hours and at a room temperature of 25° C. The cell was then restored to normal electrolysis operation at 1.0 ASI, 80° C., 12–13% NaOH, 18–19% NaCl in the anolyte, and an anolyte pH of 1.5–3.0.

The following table summarizes the cell performance before and after the membrane regeneration procedure.

TABLE III

| DOL | Cell Volts | NaOH Efficiency | Salt in Caustic | Chlorate in Caustic | Energy Requirement |
|---|---|---|---|---|---|
| 5 | 3.01 | 88 | 0.188 | 1 ppm | 2290 |
| 209 | 3.09 | 88 | 0.082 | 3 | 2350 |
| 210 | Membrane Regenerated | | | | |
| 220 | 3.02 | 88 | 0.141 | 11 | 2300 |
| 250 | 2.97 | 88 | 0.140 | 6 | 2270 |

By operating a cell according to the present invention, cell voltage was reduced by the membrane regeneration step with essentially no reduction in NaOH efficiency as shown by the data in Table III.

The cell in this example continued to operate and the membrane was regenerated two more times using the same procedure as used in the first regeneration set out above. The table below summarizes the cell performance before and after these two further membrane regeneration steps.

TABLE IV

| DOL | Cell Volts | NaOH Efficiency | Salt in Caustic | Chlorate in Caustic | Energy Requirement |
|---|---|---|---|---|---|
| 250 | 2.97 | 88 | 0.140 | 6 | 2270 |
| 305 | 3.06 | 88 | 0.117 | 2 | 2330 |
| 307 | Membrane Regenerated | | | | |
| 358 | 3.02 | 88 | 0.138 | 2 | 2300 |
| 388 | Membrane Regenerated | | | | |
| 390 | 3.08 | 88 | 0.142 | 1 | 2345 |
| 430 | 3.06 | 88 | 0.145 | 2 | 2330 |

After more than 400 days of operation long-term cell performance was maintained at an acceptable level of energy increase. At the same time, efficiency was maintained at essentially a constant level of 88% and impurities in the caustic were maintained at acceptably low levels.

INVENTION EXAMPLE 2

A lab cell like that described in Prior Art Example #1 was operated and the membrane regenerated. The membrane in this cell was an unreinforced sulfonamide type membrane. Similar membranes are described in U.S. Pat. No. 3,969,285. Membranes of this type with a reinforcing scrim have been sold commercially by E. I. duPont de Nemours and include membranes such as Nafion® 214 and Nafion® 227.

The brine feed to this cell was the same as the brine feed to the cell in Invention Example 1, except for the amount of total hardness. In order to further reduce the hardness of the brine the conventionally treated brine of Prior Art Example #1 was further treated by passing this brine through a column containing DOWEX* A-1 chelating resin made by The Dow Chemical Company. Next, the brine was acidified and the $CO_2$ removed. The resulting acidified brine contained about 25.5 wt. % NaCl, 0.65 wt. % HCl, only about 0.2 ppm Ca total hardness, and less than 1 ppm $CO_2$.

*Trademark of The Dow Chemical Company

This brine was fed to the lab cell containing the sulfonamide membrane described above and this cell was operated at 1.75 ASI, 80° C., 28–31% NaOH, 20–21% NaCl in the anolyte, and at an anolyte pH of 3–4 during normal electrolysis. Normal electrolysis was started and was continued for about 194 days.

On the 195th day after initial start-up, the membrane was regenerated in situ using the following procedure. The cell current was turned off and the current leads disconnected. Both anolyte and catholyte were drained from the cell. An acid solution of 0.5 wt. % HCl and water was added to the anolyte compartment. An acid solution of 1.0 wt. % formic acid and water was added to the catholyte compartment. Each compartment was filled with their respective acid solutions. Mixing of the acid solutions was provided by sparging a stream of nitrogen gas into the bottom of each cell compartment. The acid solutions were heated by an immersion type heater and maintained at a temperature of about 75° C. During the regeneration procedure the acid solutions were drained from the anolyte and catholyte compartments. Respective, fresh acid solutions as described above were used to refill each compartment. The drain and refill step was repeated three more times during the five hour regeneration procedure. The acid wash solutions removed from the cell were analyzed for pH and for Mg, Ca, and Fe content. The results of these analyses are tabulated in Table V.

TABLE V

| Sample | pH | ppm Mg | ppm Ca | ppm Fe |
|---|---|---|---|---|
| Anolyte #1 | 1.2 | 114 | 114 | 3000 |
| Anolyte #2 | 1.3 | 80 | 28 | 5200 |
| Anolyte #3 | 1.3 | 74 | 22 | 5000 |
| Anolyte #4 | 1.2 | 44 | 22 | 3600 |
| Catholyte #1 | 4.6 | 4 | 26 | 2600 |
| Catholyte #2 | 3.9 | 5 | 22 | 2200 |
| Catholyte #3 | 3.8 | 2 | 22 | 2200 |
| Catholyte #4 | 3.6 | 1 | 22 | 2000 |

The cell was then restored to normal operation at 1.75 ASI, 80° C., 28–31% NaOH, 20–21% NaCl in the anolyte and a pH of 3–4. The data in Table VI summarize the performance of this cell before and after the membrane regeneration procedure.

TABLE VI

| DOL | Cell Volts | NaOH Efficiency | Salt in Caustic | Energy Requirement |
|---|---|---|---|---|
| 4 | 3.48 | 88 | 0.034 | 2650 |
| 194 | 3.54 | 88 | 0.027 | 2700 |
| 195 | Membrane Regeneration | | | |
| 204 | 3.34 | 88 | 0.072 | 2540 |
| 285 | 3.40 | 86 | 0.052 | 2650 |

From the analysis of the anolyte acid solutions in Table V, it was apparent that substantially less Ca than Mg was present in these solutions. This unexpected result was exactly reversed from the normal Ca and Mg content of anolyte acid regeneration solutions for membrane cells operated and regenerated like those described in Prior Art Examples #1 and #2. The fact that the Mg concentration was higher than the Ca concentration may be attributed to the fact that $Mg(OH)_2$ is more insoluble than $Ca(OH)_2$ at the high pH's encountered at the anolyte face of the membrane and within the membrane. Although $CaCO_3$ is much more insoluble at a high pH than $Mg(OH)_2$ this calcium precipitate was substantially prevented from forming apparently because essentially all the $CO_2$ (or other "carbon oxide" forming compounds) in the feed brine had been removed. The present invention takes advantage of these facts, and the result is reduced energy consumption and an improvement in the amount of impurities in the caustic when membrane regeneration becomes necessary in order to maintain and prolong long-term cell performance.

As shown by the data in Table VI, energy consumption at the cell was reduced after the membrane regeneration step, salt in the caustic remained acceptably low, and cell performance after 285 days of operation was essentially equal to the level of performance that was obtained when the membrane was new.

Also note in Table V, the high concentration of Fe present. This iron was corrosion coming from the cathode, among other Fe sources, as a visual inspection of the cathode showed. Control of this corrosion is shown in Invention Example IV below.

INVENTION EXAMPLE 3

A lab cell like that described in Prior Art Example #1 was operated and the membrane regenerated. The membrane in this cell was Nafion ® 324. The acid brine feed to the cell was the same as described in Invention Example #2. The cell was operated at 1.0 ASI, 80° C., 17–18 wt. % NaOH, 19–20% NaCl in the anolyte, and at an anolyte pH of 1.5–3.0. Normal electrolysis was started and continued for 529 days.

On the 530th day after initial start-up, the membrane was regenerated in situ using the following procedure. The cell was turned off and was then flushed with conventionally treated brine of the same type as described in Prior Art Example #1. This was done to remove the strong caustic from the catholyte and the acid-brine solution from the anolyte compartment. Both cell compartments were then drained. The anolyte compartment was then filled with a 0.5 wt. % HCl and water solution. The cathode compartment was filled with a 1.0 wt. % HCl and water solution which also contained 1000 ppm of ANCOR ® OW ®-1 corrosion inhibitor, 1000 ppm isopropyl alcohol, and 220 ppm TRITON ® X-100 wetting agent. ANCOR ® OW ®-1 is a registered trademark of Air Products and Chemicals, Incorporated, and ANCOR ® OW ®-1 corrosion inhibitor is a commercial product available from that company. It is composed of a group of acetylic alcohols, a major portion of which is 1-hexyn-3-ol. TRITON is a trademark of Rohm and Haas Company, and TRITON X-100 is a commercial product available from that company. TRITON X-100 is a cogeneric mixture of isooctyl phenoxy polyethoxy ethanols.

The corrosion inhibitor and wetting agent were added in order to protect the cathode from corrosion during the regeneration procedure. Actually this corrosion technique did not work as well as the cathodic protection method described in the next example, Invention Example 4.

Mixing of the acid solutions in their separate chambers 10 and 12 was provided by sparging a stream of $N_2$ gas into the bottom of both cell compartments. The acid solutions were heated by an immersion type heater and maintained at 75°–80° C. During the regeneration procedure the respective acid solutions were added to each cell compartment in 75 ml aliquots. This adding of additional fresh acid was repeated four times during the 4½ hour regeneration procedure. Before restoring the cell to normal operation both acid solutions were drained from the cell, and then the membrane was substantially dried by heating with the immersion heater described previously. The drying step was carried out at a temperature of between 100° C. to 200° C. and required about ten minutes. The cell was then restored to normal electrolysis operation.

Cell performance data obtained before and after the regeneration procedure are tabulated in Table VII.

TABLE VII

| DOL | Cell Volts | NaOH Efficiency | Salt in Caustic | Energy Requirement |
|---|---|---|---|---|
| 5 | 3.02 | 84 | 0.130 | 2410 |
| 526 | 3.18 | 84 | 0.031 | 2540 |
| 530 | Membrane Regenerated | | | |
| 535 | 3.12 | 89 | 0.029 | 2350 |
| 575 | 3.15 | 88 | 0.027 | 2400 |

The data in Table VII shows that after the regeneration procedure, energy consumption was reduced, efficiency was surprisingly increased by a surprising amount, voltage was reduced, and salt impurity in the caustic remained constant. Being able to use a membrane cell for 575 days and still have cell performance of this quantity is not to be expected by those skilled in the art. Even more unexpected is being able to continue.

The cell in this example continued to be operated, and a second and third regeneration were used at later dates according to the following procedure. The cell voltage was reduced to about 2.1 volts. In this way the cathode potential was maintained at slightly above the cathode decomposition voltage (defined above as the "cathodic protection voltage"); therefore, corrosion of the cathode was substantially prevented. Normal acid-brine feed was fed to the anolyte compartment at the flow rate normally used during cell electrolysis. $H_2O$ was added to the catholyte at an increased rate in order to reduce the catholyte pH to about pH 8–9. The membrane was regenerated in this manner at room temperature for 25 hours during the 2nd regeneration and for 6 hours during the 3rd regeneration. A summary of cell performance before and after these regeneration procedures is given in Table VIII.

TABLE VIII

| DOL | Cell Volts | NaOH Efficiency | Salt in Caustic | Energy Requirement |
|---|---|---|---|---|
| 575 | 3.15 | 88 | 0.027 | 2400 |
| 578 | 3.19 | 88 | 0.015 | 2430 |
| 585 | Membrane Regenerated 2nd Time | | | |
| 591 | 3.05 | 87 | 0.064 | 2350 |
| 625 | 3.16 | 90 | 0.026 | 2350 |
| 636 | Membrane Regenerated 3rd Time | | | |
| 638 | 3.03 | 87 | 0.064 | 2330 |
| 790 | 3.13 | 87 | 0.052 | 2410 |

The data in Table VIII indicate that long term cell performance was maintained for almost 800 days with essentially the same energy consumption and product purity as when the membrane was new. This is, indeed, unexpected.

INVENTION EXAMPLE 4

A lab cell like that described in Prior Art Example #1 was operated and the membrane regenerated using two different procedures. The membrane in this cell was Nafion ® 324 and the acid-brine feed was the same as the acid-brine used in Invention Example #1. The cell was operated at 1.0 ASI, 80° C., 12–13% NaOH, 18–19 wt. % NaCl in the anolyte, and at an anolyte pH of 1.5–3.0. Normal electrolysis was started and continued for 166 days.

On the 167th day after initial start-up, the membrane was regenerated in situ using the following procedure. The electric current to the cell was turned completely off. The current leads were disconnected from the anode and cathode, and the cell remained electrically isolated from ground potential. The same type acid-brine used during normal electrolysis was fed into the anolyte compartment. Water was fed into the catholyte compartment. The flow rates of both the acid brine and the water were the same as what they had been during normal cell operation. Samples of anolyte and catholyte were taken periodically during this procedure. The membrane was regenerated in this manner at a room temperature of 23° C. for 23 hours. The cell was then restored to normal cell operation and continued to be operated up to the 256th day after initial start-up.

On the 257th day the membrane was again regenerated using the same procedure as was used during the first regeneration except for the following changes. Cell current and voltage were reduced and cell voltage was then maintained at 2.1 volts by passing a small current through the cell during the entire regeneration procedure. This step was done in order to maintain the cathode potential at slightly above the decomposition voltage in order to substantially prevent corrosion of the cathode. Additional water flow to the catholyte compartment was also used in order to further reduce the catholyte pH. After about 10 minutes into the regeneration procedure the rate of water addition was reduced to the same flow as used during normal electrolysis. Samples of the anolyte and catholyte were taken periodically during the regeneration procedure. A summary of the analyses of the electrolyte samples taken during the 1st and 2nd membrane regeneration procedures are given in Tables IX and X, respectively. A summary of cell electrolysis performance before and after each regeneration is given in Table XI.

TABLE IX

| | 1st REGENERATION | | | | |
|---|---|---|---|---|---|
| Sample | Hours Regeneration in Progress | ppm Mg | ppm Ca | ppm Fe | pH |
| Anolyte #1 | 1 | <2 | <2 | <2 | 1.7 |
| Anolyte #2 | 3 | 6.4 | <2 | 4.4 | 0 |
| Anolyte #3 | 5 | 6.7 | <2 | 2.6 | 0 |
| Anolyte #4 | 6 | 6.8 | <2 | 77 | 0 |
| Anolyte #5 | 6-22 composite | 4.9 | <2 | 97 | 0 |
| Anolyte #6 | 23 | 3.0 | <2 | 87 | 0 |
| Catholyte #1 | 1 | <4 | <4 | <4 | 14 |
| Catholyte #2 | 3 | <4 | <4 | <4 | 13.8 |
| Catholyte #3 | 5 | <4 | <4 | <4 | 12.4 |
| Catholyte #4 | 6 | <4 | <4 | 58 | 4.2 |
| Catholyte #5 | 6-22 composite | <4 | <4 | 55 | -- |
| Catholyte #6 | 23 | <4 | <4 | 58 | 4.0 |

TABLE X

| | 2nd REGENERATION | | | | |
|---|---|---|---|---|---|
| Sample | Hours Regeneration in Progress | ppm Mg | ppm Ca | ppm Fe | pH |
| Anolyte #1 | 1 | 20 | 5.8 | <1 | 1.2 |
| Anolyte #2 | 3 | 11 | 9.7 | 4.7 | 0 |
| Anolyte #3 | 6 | 7.5 | 2.4 | 2.3 | 0 |
| Anolyte #4 | 23 | 7.3 | 2.2 | 1.2 | 0 |
| Catholyte #1 | 1 | <1 | <1 | <1 | 12.8 |
| Catholyte #2 | 3 | <1 | <1 | <1 | — |
| Catholyte #3 | 6 | <1 | <1 | <1 | 4.0 |
| Catholyte #4 | 23 | <1 | 2 | <1 | 8.1 |

TABLE XI

| DOL | Cell Volts | NaOH Efficiency | Salt in Caustic | Energy Requirement |
|---|---|---|---|---|
| 12 | 3.04 | 88 | 0.190 | 2310 |
| 128 | 3.01 | 88 | 0.183 | 2290 |
| 165 | 3.11 | 88 | 0.085 | 2370 |
| 167 | Membrane Regenerated 1st Time | | | |
| 171 | 3.06 | 88 | 0.168 | 2330 |
| 214 | 3.03 | 89 | 0.126 | 2280 |
| 256 | 3.18 | 90 | 0.053 | 2370 |
| 257 | Membrane Regenerated 2nd Time | | | |
| 260 | 3.02 | 89 | 0.132 | 2270 |

The results of the analyses of samples taken during the membrane regeneration procedures confirm that by using the 2nd regeneration method, essentially no corrosion of the cathode occurred. The data in Table XI demonstrate that long term cell performance and acceptable caustic purity can be maintained by using brine containing only low amounts of $CO_2$ ("carbon oxide") and suitable membrane regeneration procedures.

What is claimed is:

1. A method of operating and regenerating an electrolysis cell which electrolyzes an aqueous alkali metal halide solution (brine) to a halogen at the cell's anode and an alkali metal hydroxide at the cell's cathode, which cell contains a permselective cation exchange membrane disposed between the anode and cathode to form an anolyte and catholyte compartment so as to separate the cell's anolyte from its catholyte, which method comprises the combination of steps of:

A. during at least 50% of the cell's normal electrolysis operation, feeding to and electrolyzing in said cell a brine which, at least at the time immediately prior to the brine's becoming part of the anolyte, contains no more than about 5 ppm hardness (expressed as ppm calcium) and no more than about 70 ppm "carbon oxide" (expressed as ppm $CO_2$);

B. regenerating the membrane (after it has become fouled with compounds of multivalent cations accumulated from the brine fed to the cell during the normal cell electrolysis step of Step (A) above) by contacting the membrane on at least one of its sides with a solution capable of dissolving the multivalent cation compounds fouling the membrane for a time sufficient to dissolve a substantial amount of said compounds fouling said membrane, said solution having a pH lower than the pH of the electrolyte which contacted that side of the membrane during the normal cell electrolysis step, Step (A) above.

2. The method of claim 1 wherein the alkali metal halide solution is a potassium chloride solution.

3. The method of claim 1 wherein the alkali metal halide solution is an aqueous sodium chloride solution.

4. The method of claim 3 wherein the brine fed to the cell contains less than about 50 ppm "carbon oxide".

5. The method of claim 3 wherein the brine fed to the cell contains less than about 25 ppm "carbon oxide".

6. The method of claim 3 wherein the brine fed to the cell contains less than 10 ppm "carbon oxide".

7. The method of claim 3 wherein the brine fed to the cell contains less than about 5 ppm "carbon oxide".

8. The method of claim 3 wherein the brine fed to the cell contains less than about 2 ppm "carbon oxide".

9. The method of claim 3 which further comprises drying the membrane after regenerating it in Step (B).

10. The method of claim 3 wherein the membrane is regenerated in place in the cell and both compartments contain liquid solutions.

11. The method of claim 10 wherein during Step (B) the cell's voltage is reduced to less than about 80% of cell's normal electrolysis voltage employed in Step (A).

12. The method of claim 10 wherein during Step (B) the cell's voltage is reduced to the cell's "cathodic protection voltage" so that the cell's cathode is afforded cathodic protection during the membrane regeneration.

13. The method of claim 10 wherein the pH of the solution in the anolyte chamber is decreased to less than 2.0 during Step (B).

14. The method of claim 10 wherein the pH of the solution in the anolyte chamber is decreased during Step (B) to a range of from about 0.5 to about 2.0.

15. The method of claim 10 wherein the solution in the catholyte chamber is maintained at a pH below 10 during Step (B).

16. The method of claim 10 wherein the solution in the catholyte chamber is maintained at a pH below about 8 during Step (B).

17. The method of claim 10 wherein Step (B) is carried out for at least one hour.

18. The method of claim 10 wherein Step (B) is carried out for at least four hours.

19. The method of claim 10 wherein Step (B) is carried out for at least about ten hours.

20. The method of claim 10 wherein the amount of "carbon oxide" employed in the brine feed of Step (A) is less than about 2 ppm; wherein during Step (B) the cell's voltage is reduced to the cell's "cathodic protection voltage"; wherein during Step (B) the pH of the solution in the anolyte compartment is maintained in a range of from 0.5 to about 2.0 during substantially most of the time required for Step (B) to be accomplished; wherein the pH of the solution in the catholyte compartment is maintained at a level below about pH 8 for at least half of the time during which Step (B) is carried out; and wherein Step (B) is carried out for at least ten hours.

* * * * *